United States Patent [19]

Nishi et al.

[11] Patent Number: 4,551,592

[45] Date of Patent: Nov. 5, 1985

[54] PUSH-BUTTON SWITCH

[75] Inventors: Hiroyuki Nishi; Mitsuji Hayashi, both of Nagaokakyo; Motoyuki Tomizu, Kyoto, all of Japan

[73] Assignee: Omron Tateisi Electronics, Co., Kyoto, Japan

[21] Appl. No.: 585,465

[22] Filed: Mar. 2, 1984

[30] Foreign Application Priority Data

Mar. 5, 1983 [JP] Japan ..... 58-31715[U]

[51] Int. Cl.[4] ..... H01H 5/30

[52] U.S. Cl. ..... 200/67 D; 200/340

[58] Field of Search ..... 200/67 D, 67 DA, 67 DB, 200/67 A, 67 R, 159 R, 329, 340, 5 A, 243; 74/97, 100 P

[56] References Cited

U.S. PATENT DOCUMENTS

| | | | |
|---|---|---|---|
| 3,187,132 | 6/1965 | Dennison | 200/67 D |
| 4,362,910 | 12/1982 | Boebel et al. | 200/67 D X |
| 4,447,685 | 5/1984 | Ohashi et al. | 200/67 D |

FOREIGN PATENT DOCUMENTS

| | | | |
|---|---|---|---|
| 1388072 | 12/1964 | France | 200/67 D |
| 690220 | 4/1953 | United Kingdom | 200/67 D |

*Primary Examiner*—Stephen Marcus
*Assistant Examiner*—Ernest G. Cusick
*Attorney, Agent, or Firm*—Wegner & Bretschneider

[57] ABSTRACT

An improved push-button switch which is so arranged that generation of heat at a journalled portion of a movable piece is eliminated by forming contacts of the movable piece into double-break contacts so that no current flows through the journalled portion, while a sufficient contact gap is available even when the push-button switch is made into a compact size.

2 Claims, 5 Drawing Figures

PUSH-BUTTON SWITCH

BACKGROUND OF THE INVENTION

The present invention generally relates to a push-button switch and more particularly, to an improved switch mechanism for a push-button switch.

Conventionally, there has been known a push-button switch, for example, as shown in FIG. 1, which generally includes a casing 1, a push-button 2 movably provided at the upper end portion of the casing 1, an operating member 3 provided in the casing 1 for vertical movement together with the push-button 2, and a switch mechanism accommodated in the lower end portion of said casing 1. The switch mechanism referred to above is constituted by a base member 4, a normally closed terminal 5, a normally open terminal 6 and a common terminal 7 which all are fixed to said base member 4, a rotary member 8 pivotally provided on the base member 4, a movable piece 9 journalled at its one end in the common terminal 7, and a reversing spring 10 fixed, at its one end, to the rotary member 8, and engaged, at its other end, with said movable piece 9. Thus, upon depression of the push-button 2 so as to rotate the rotary member 8 in the counterclockwise direction through the operating member 3, the movable piece 9 is adapted to be reversed or directed downwardly.

The known switch mechanism as described so far, however, has such a problem that electric current flowing through the journalled portion of the movable piece 9 in the common terminal 7 produces heat at such journalled portion, since the common terminal 7 and the movable piece 9 are subjected to a linear contact or point contact with each other, thus providing an extremely small area for the current to pass therethrough. Moreover, there has also been a disadvantage in that, when it is intended to reduce the size of the push-button switch of the above described type, the contact gap between the movable piece 9 and the normally open contact or normally closed contact is inevitably reduced, thus resulting in deterioration of insulating characteristics, etc.

SUMMARY OF THE INVENTION

Accordingly, an essential object of the present invention is to provide an improved push-button switch in which generation of heat at a journalled portion of a movable piece is prevented, while a sufficient contact gap may be provided even when the size of the push-button switch is reduced, with substantial elimination of disadvantages inherent in the conventional push-button switches of this kind.

Another important object of the present invention is to provide a push-button switch of the above described type which is simple in construction and stable in operation and can be readily manufactured on a large scale at low cost.

In accomplishing these and other objects, according to the present invention, the contacts of a movable piece are formed into double-break contacts so that no electric current flows through a journalled portion of the movable piece.

More specifically, according to one preferred embodiment of the present invention, there is provided a push-button switch which comprises a base member provided, on its one surface, with a bearing portion, two fixed contacts, and a pair of studs, a link member having, at its one end, a support shaft pivotally received in said bearing portion of the base member, and at its other end a hinge portion, a movable piece made of a T-shaped electrically conductive plate having, at its broad end two movable contacts to be connected with said fixed contacts, and pivotally engaged at its narrow end with the hinge portion of the said link member, a reversing spring in the form of a generally U-shaped plate spring engaged, at its free ends, with said studs in a bent state, and at its base, with said movable piece, and a push-button movably provided for vertical movements with respect to said base so as to depress the link member in the vicinity of said hinge portion thereof.

By the arrangement according to the present invention as described above, an improved push-button switch has been advantageously provided through simple construction.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
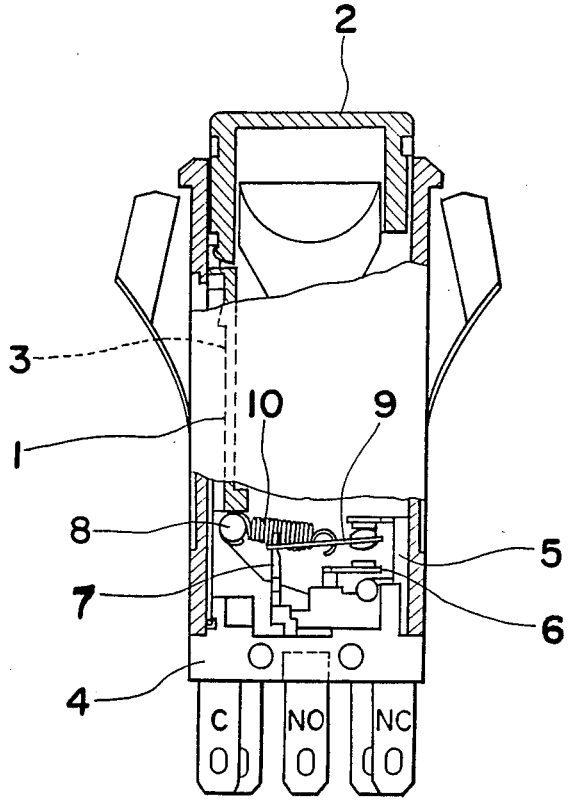
Fig. 1 PRIOR ART
FIG. 1 is a front elevational view, partly in section, of a conventional push-button switch (already referred to)

Before the description of the present invention proceeds, it is to be noted that like parts are designated by like reference numerals throughout the accompanying drawings.

Referring now to FIGS. 2 through 5, there is shown a push-button switch according to one preferred embodiment of the present invention, which generally includes a base member 11, a link member 19, a movable piece 23, a reversing spring 30, a casing 33 fixed to the base member 11, an operating member 35 arranged to be vertically movable with respect to the casing 11, and a push-button 37 secured to the upper surface of the operating member 35.

Figure 4:
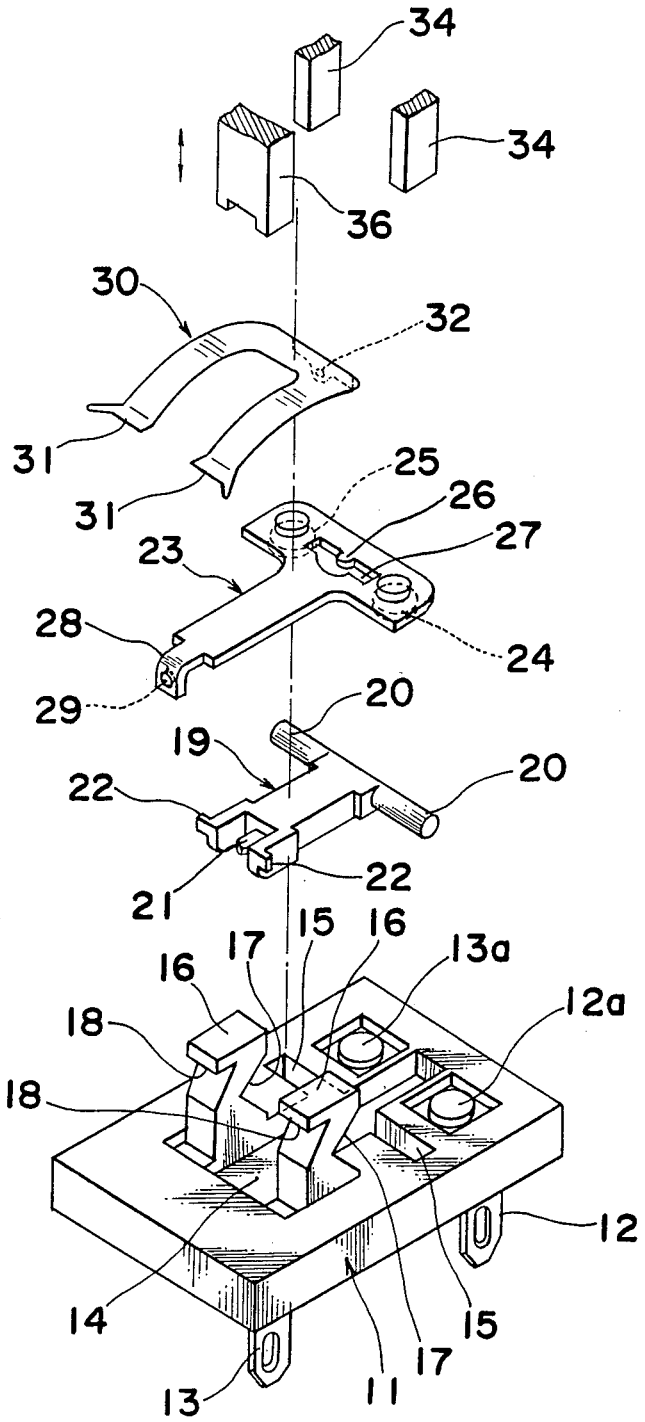
FIG. 4 is an exploded perspective view of a switch mechanism employed in the arrangement of FIG. 2.

More specifically, as shown in FIG. 4, two terminals 12 and 13 respectively having fixed contacts **12*a* and 13*a* are secured to the base member 11, while, on the upper surface of the base member 11, there are formed a recess 14, a concave bearing portion 15 continuously extending towards opposite sides from said recess 14, and a pair of studs 16 erected at the opposite sides of the recess 14. Each of the studs 16 is formed with a V-shaped engaging groove 17 at its one side face confronting the fixed contacts 12*a* and 13*a*, and also, with a stopper face 18** at its other side face as illustrated.

The link member 19 formed, for example, by one piece molding of a synthetic resin, has a support shaft 20 extending outwardly towards opposite sides from one end thereof so as to be pivotally received in the bearing portion 15 of the base member 11, and is provided, at its other end, with a hinge portion 21 having a pointed forward end. The hinge portion 21 made of a metallic material is secured to the link member 19, for example, by insert molding. Moreover, at opposite sides of the other end of the link member 19, there are formed stopper pieces 22 so that, upon upward rotation of the link member 19 about the support shaft 20, the stopper pieces 22 are brought into contact with the stopper faces 18 of the studs 16 on the base member 11 so as to restricted the pivotal movement.

Meanwhile, the movable piece 23 is formed, for example, by blanking a sheet of conductive plate into a T-shape, and has two movable contacts 24 and 25 fixed to the under surface of its one broad end, at the central portion of which there is formed a through-opening or slit 27 provided with a small engaging projection 26. The narrow other end of the movable piece 23 is folded downwardly to form a folded piece 28, which is formed, on its inner surface, with an engaging portion 29 for engagement with the hinge portion 21 of the link member 19 at one point.

The reversing spring 30 made of a plate spring generally in a U-configuration is curved upwardly to a certain extent, and is attached to the base member 11 by engaging free end portions 31 thereof with the engaging grooves 17 of the studs 16 in a slightly pushed and bent state, with a recess 32 formed at its base being engaged with the engaging projection 26 of the movable piece 23 at one point.

In the casing 33 described earlier, two terminals 39 and 40 are inserted for feeding power to a lamp 38 incorporated in the push-button 37. Moreover, on the under surface of the casing 33, there are provided two pins 34 depending therefrom, and the lower ends of the pins 34 depress the upper surface of the support shaft 20 of the link member 19 received in the bearing portion 15 of the base member 11 for preventing the support shaft 20 from disengagement. Furthermore, an operating pin 36 is provided to depend from the under surface of the operating member 35, and is adapted to depress, by its lower end face, the upper surface of the other end of the link member 19.

By the above arrangement, functionings of the push-button switch according to the present invention will be described hereinbelow.

Figure 2:
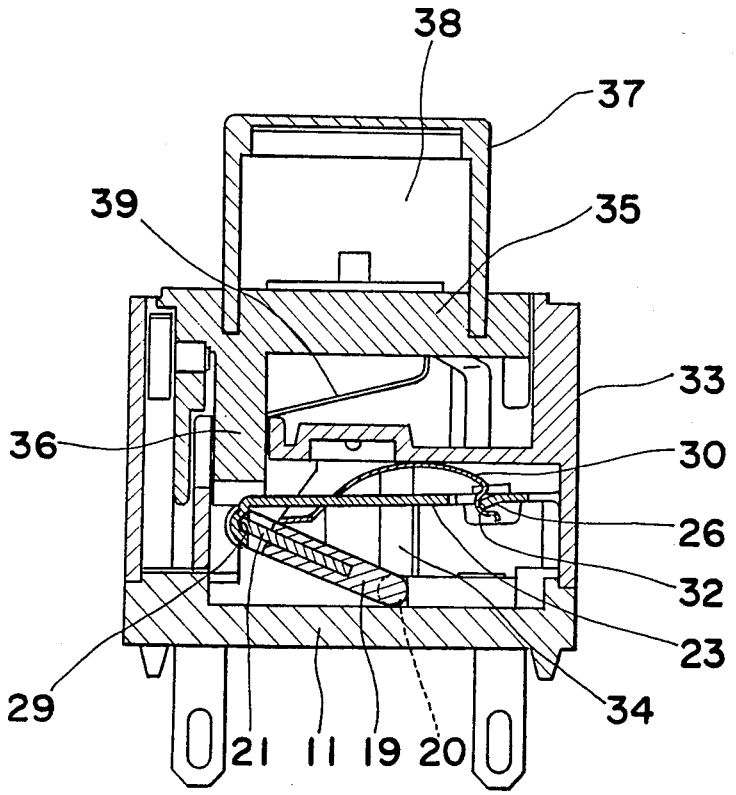
FIG. 2 is a longitudinal sectional view of a push-button switch according to one preferred embodiment of the present invention.
Figure 3:
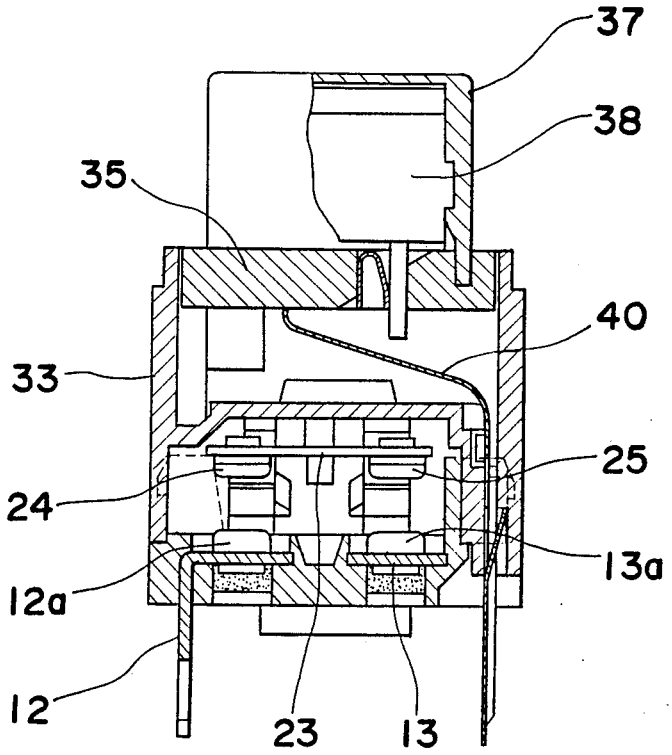
FIG. 3 is a side elevational view, partly in section, of the push-button switch of FIG. 1.

In the first place, during the ordinary period, the link member 19 has been provided upwardly about the support shaft 20 by the spring force of the reversing spring 30 as shown in FIGS. 2 and 3, and following the above, the movable piece 23 is located at the upper portion, with the movable contacts 24 and 25 being spaced from the fixed contacts 12*a* and 13*a*.

Figure 5:
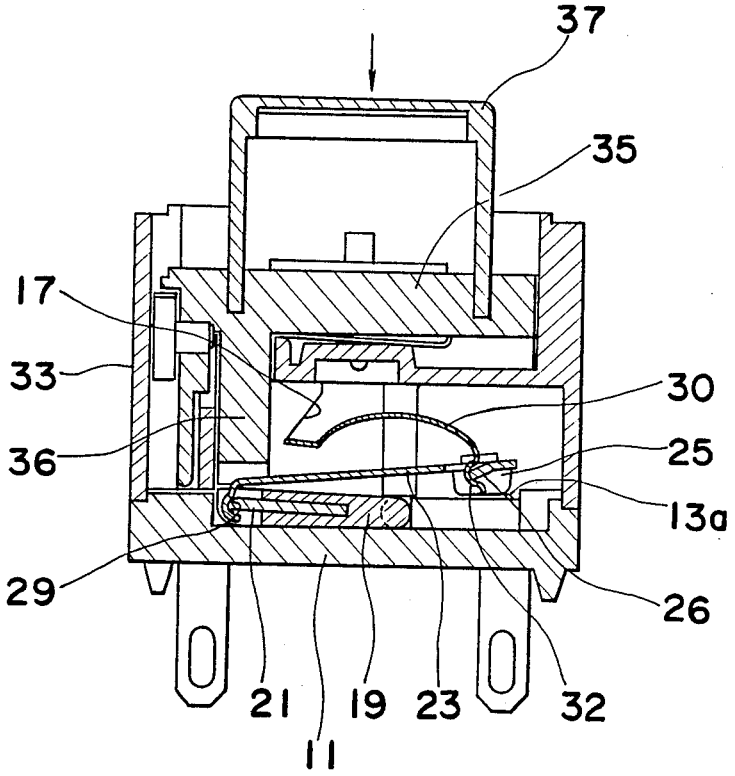
FIG. 5 is a view similar to FIG. 2, which is particularly explanatory of functioning thereof.

In the above state, upon depression of the push-button 37, the operating member 35 descends simultaneously, and the other end of the link member 19 is depressed downwardly by the operating pin 36. Thus, when the three engaging points, i.e. the engaging point between the reversing spring 30 and the engaging groove 17, the engaging point between the reversing spring 30 and the movable piece 23, and the engaging point between the movable piece 23 and the link member 19, are formed into a straight line, the movable piece 23 is instantaneously directed downwardly, and the two movable contacts 24 and 25 thereof simultaneously contact the corresponding fixed contacts 12*a* and 13*a* to close the contacts (FIG. 5). Therefore, the electric current flows from one terminal to the other terminal through the broad end portion of the movable member 23.

When the push-button 37 is released from the depressing force, the state is restored back to the state of FIG. 2 again by the spring force of the reversing spring 30.

In the foregoing embodiment, since the hinge portion 21 of the link member 19 and the other end of the movable member 23 engage with each other at one point, and the one end of the movable piece 23 and the other end of the reversing spring 30 engage with each other also at one point, the movable piece 23 may be laterally pivoted freely. Accordingly, even if the left and right fixed contacts 12*a* a and 13*a* or the left and right movable contacts 24 and 25 are different in heights, it is possible for the movable piece 23 to be freely pivoted so as to bring both of the movable contacts 24 and 25 into contact with the corresponding fixed contacts 12*a* and 13*a* under equal contact pressure, with a consequent improvement of the stability for switching.

Moreover, since the link member 19 is formed by one piece molding of a resinous material, a sufficient insulation may be achieved even in the vicinity of the contacts. Furthermore, since only the hinge portion 21 is made of a metallic material, abrasion due to engagement with the movable piece 23 may be reduced, and a stable engagement may be maintained for a long period of time.

It is to be noted here that, in the foregoing embodiment, although only two fixed contacts 12*a* and 13*a* are described to be provided on the upper surface of the base member 11, the arrangement may be so modified that another two normally closed fixed contacts are provided also at the upper portion confronting said fixed contacts so that during the ordinary period, the movable contacts 24 and 25 contact the normally closed fixed contacts, while, during the functioning, the movable contacts 24 and 25 contact the fixed contacts 12*a* and 13*a* at the lower side.

As is clear from the foregoing description, according to the push-button switch of the present invention, since the double-break contacts are provided at the broad end portion of the T-shaped movable member, no current flows through the journalled portion of the movable piece as in the conventional arrangement, and thus, the drawback such as the generation of heat at such journalled portion may be eliminated. Moreover, since the contacts of the movable piece are of the double-break contacts, the contact gap may be increased without increasing the distance between the confronting movable contacts and fixed contacts, so that a sufficiently large contact gap may be obtained even when the size of the push-button switch is reduced.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A push-button switch, comprising:

a base member provided on one surface with a bearing portion, fixed contacts and a pair of studs;

a link member comprising a first end having a support shaft pivotally received in said bearing portion of said base member, and a second end having a hinge portion;

a movable, T-shaped electrically conductive plate piece having a broad end which has movable contacts for connection to said fixed contacts, and a narrow end pivotally engaged with the hinge portion of said link member;

a reversing spring in the form of a generally U-shaped plate spring in a bent configuration, engaged with said studs at its free ends and engaged with said movable piece at its base; and a push-button movably disposed for vertical movement with respect to said base, to depress the link member in the vicinity of said hinge portion.

2. A push-button switch as claimed in claim 1, wherein the hinge portion of said link member is engaged with the narrow end of said movable member at one point, with one end of said movable member being also engaged with the base of said reversing spring at one point.

* * * * *